US005297704A

United States Patent [19]

Stollmeyer

[11] Patent Number: 5,297,704

[45] Date of Patent: Mar. 29, 1994

[54] NOZZLE SAVER

[76] Inventor: Laurence T. Stollmeyer, 1359 Singingwood, Pomona, Calif. 91767

[21] Appl. No.: 81,697

[22] Filed: Jun. 25, 1993

[51] Int. Cl.[5] ..... B65D 5/72

[52] U.S. Cl. ..... 222/567; 24/17 AP; 222/402.1; 222/543; 239/337; 239/600; 248/309.1

[58] Field of Search ..... 222/402.1, 402.2, 402.24, 222/530, 538, 566, 567, 527, 192, 543; 239/600, 602, 273, 337, 397; 24/17 A, 17 B, 17 AP, 30.5 P; 248/229, 300, 309.1, 317

[56] References Cited

U.S. PATENT DOCUMENTS

| | | | |
|---|---|---|---|
| 2,908,446 | 10/1959 | Strouse | 222/402.1 X |
| 2,968,441 | 1/1961 | Holcomb | 222/402.1 X |
| 3,050,578 | 8/1962 | Huebner | 24/17 AP X |
| 3,127,064 | 3/1964 | Fairchild | 222/543 |
| 3,186,645 | 6/1965 | Eberlein | 222/567 X |
| 3,216,628 | 11/1965 | Fergusson | 222/402.1 |
| 3,472,457 | 10/1969 | McAvoy | 239/337 |
| 4,141,452 | 2/1979 | Martin et al. | 248/309.1 X |
| 4,157,166 | 6/1979 | Voelker | 248/317 |
| 4,227,668 | 10/1980 | Ernst | 248/317 |
| 4,342,438 | 8/1982 | Speedie | 24/17 A X |
| 4,466,159 | 8/1984 | Burrage | 24/17 AP X |
| 4,991,750 | 2/1991 | Moral | 222/567 X |
| 5,012,558 | 5/1991 | Willoughby | 24/17 AP X |
| 5,058,783 | 10/1991 | Antonelli | 222/530 X |

*Primary Examiner*—Kevin P. Shaver

[57] ABSTRACT

A device for use in combination with a nozzle cap of a spray dispenser and an elongate spray tube inserted into a recessed seat of the nozzle cap for preventing the dislodgement of and the separation of the elongate spray tube from the nozzle cap. The device is a flat strip of flexible material having an in-line pattern of spaced openings. A first opening is stretched over the nozzle cap and the remaining openings receive the elongate spray tube in a weaving-type pattern.

2 Claims, 1 Drawing Sheet

NOZZLE SAVER

BACKGROUND OF THE INVENTION

1. Field of the Invention

This invention relates to a device that eliminates the loss of the nozzle tube found on nozzle tube type dispensers.

2. Description of the Prior Art

Some dispensers come with a nozzle tube, that is inserted into a recess in the dispensers cap, allowing for a concentrated, directional flow of the spray. The problem with such type of dispenser is that the nozzle tube is held into place only by an interference fit, and almost always falls off and is lost before the contents of the container have been completely used. This invention eliminates this problem.

SUMMARY OF THE INVENTION

The invention relates to a device which will enable the user of nozzle tube type dispensers, the ability to utilize the nozzle tube, until the complete depletion of the dispensers contents is achieved. It comprises a means for permanently attaching the nozzle tube to the cap.

It is an object of this invention to provide a device which is very inexpensive to manufacture and that will allow its user all the benefits of a nozzle tube type dispenser, until the depletion of it's contents is achieved.

DESCRIPTION OF THE PREFERRED EMBODIMENT

Figure 1:
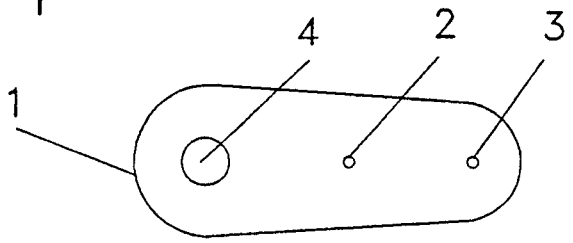
FIG. 1 is a plan view showing an embodiment of the un-installed nozzle saver.
Figure 2:
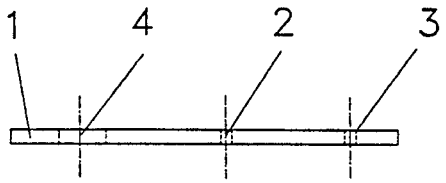
FIG. 2 is an elevation view showing an embodiment of the un-installed nozzle saver.

Referring to FIGS. 1 and 2, an embodiment of the nozzle-saver is shown, in its un-installed state. The nozzle saver unit comprises of a flat flexible material 1, with a large opening 4 at one end, and two smaller punctures 2 and 3 placed on centerline equally spaced in the distance between large opening 4 and opposite end.

Figure 3:
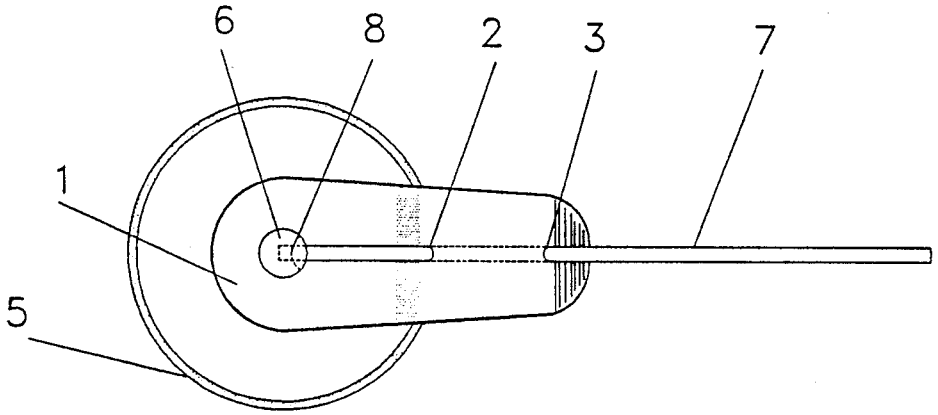
FIG. 3 is a plan view showing an embodiment of an installed nozzle saver.
Figure 4:
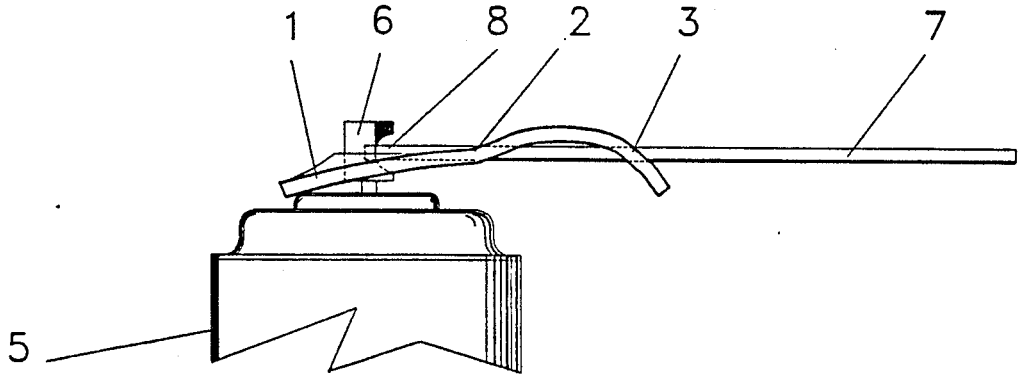
FIG. 4 is an elevation view showing an embodiment of an installed nozzle saver.

Referring to FIGS. 3 and 4, an embodiment of the nozzle-saver is shown installed on the cap 6 of a nozzle tube type dispenser 5, with large opening 4 stretched over cap 6. Nozzle tube 7 has been inserted through punctures 2 and 3 and re-inserted back into recessed seat 8.

This invention causes a tension to be applied on nozzle-tube 7 at the point between punctures 2 and 3, thereby holding nozzle tube 7 from slipping out of punctures 3 and 4.

I claim:

1. In combination, a nozzle cap for a spray dispenser, an elongate spray tube inserted into a recessed seat of said nozzle cap, and means for preventing the dislodgement of and the separation of said elongate spray tube from the nozzle cap; said means comprising a flat strip of flexible material having an in-line pattern of spaced openings, a first of said openings being of a size to allow stretching of the material over the nozzle cap, the remaining openings being smaller than said first opening and said elongate spray tube passing through said remaining openings in a weaving-type pattern.

2. The combination according to claim 1, wherein the number of openings is three.

* * * * *